US006827297B2

(12) United States Patent
Hockenberger

(10) Patent No.: US 6,827,297 B2
(45) Date of Patent: Dec. 7, 2004

(54) FUEL INJECTION VALVE FOR INTERNAL COMBUSTION ENGINES

(75) Inventor: Axel Hockenberger, Kueltuer Sitesi (TR)

(73) Assignee: Robert Bosch GmbH, Stuttgart (DE)

( * ) Notice: Subject to any disclaimer, the term of this patent is extended or adjusted under 35 U.S.C. 154(b) by 221 days.

(21) Appl. No.: 10/069,506

(22) PCT Filed: Jun. 12, 2001

(86) PCT No.: PCT/DE01/02180

§ 371 (c)(1),
(2), (4) Date: Jun. 12, 2002

(87) PCT Pub. No.: WO02/01065

PCT Pub. Date: Jan. 3, 2002

(65) Prior Publication Data

US 2002/0162906 A1 Nov. 7, 2002

(30) Foreign Application Priority Data

Jun. 27, 2000 (DE) ..... 100 31 265

(51) Int. Cl.[7] ..... F02M 61/00; B05B 1/30

(52) U.S. Cl. ..... 239/533.12; 239/533.3; 239/585.1; 239/585.5; 239/88

(58) Field of Search ..... 239/88, 89, 90, 239/91, 92, 95, 96, 533.2, 533.3, 533.7, 533.8, 533.9, 533.12, 585.1–585.5, 460, 456, 463, 490, 483; 251/129.15, 129.21

(56) References Cited

U.S. PATENT DOCUMENTS 3,836,080 A * 9/1974 Butterfield et al. ..... 239/96
4,153,205 A * 5/1979 Parrish, Jr. ..... 239/533.9
4,408,722 A * 10/1983 Frelund ..... 239/453
4,470,548 A * 9/1984 Ushimura ..... 239/533.3
4,540,126 A 9/1985 Yoneda et al.
5,033,679 A 7/1991 Golev et al.
5,163,621 A 11/1992 Kato et al.
5,890,660 A * 4/1999 Stevens ..... 239/533.3

FOREIGN PATENT DOCUMENTS

DE 196 34 933 A 3/1998
DE 199 31 891 A 1/2001

* cited by examiner

*Primary Examiner*—Davis Hwu
(74) *Attorney, Agent, or Firm*—Ronald E. Greigg

(57) ABSTRACT

A fuel injection valve having a valve body (5), in which a pistonlike valve member (7) is guided longitudinally displaceably in a bore (15) embodied as a blind bore. A conical valve seat (23) and at least one injection port (25) are embodied on the bottom face of the bore (15), and the injection port connects a pressure chamber (11), formed between the portion (107) of the valve member (7) toward the combustion chamber and the bore (15), with the combustion chamber. On the end toward the combustion chamber of the valve member (7), there is a valve member tip (13), on which a first conical face (30), adjacent to the valve member (7), and a second conical face (32), disposed on the combustion chamber side of the first conical face, are embodied. The cone angle ($\alpha$) of the first conical face (30) is less, and the cone angle ($\beta$) of the second conical face (32) is greater, than the cone angle ($\gamma$) of the valve seat (23), so that a sealing edge (40) is formed at the transition of the two conical faces (30, 32). Embodied on the first conical face (30) is an encompassing annular groove (35), which limits an increase in the hydraulically effective seat diameter caused by the plastic deformation of the sealing edge (40) and the valve seat (23) to a precisely defined extent (FIG. 2).

18 Claims, 2 Drawing Sheets

FUEL INJECTION VALVE FOR INTERNAL COMBUSTION ENGINES

CROSS-REFERENCE TO RELATED APPLICATIONS

This application is a 35 U.S.C. 371 application of PCT/DE 01/02180, filed on Jun. 12, 2001.

BACKGROUND OF THE INVENTION

1. Field of the Invention

The invention is based on a fuel injection valve for internal combustion engines.

2. Description of the Invention

One fuel injection valve of the type with which this invention is concerned, is known from German Patent Disclosure DE 19634933A1. In this known valve, on the end toward the combustion chamber of the valve member,there is a valve member tip with two conical faces. A first conical face is adjacent to the valve member shaft and has an opening angel that is less than that of the conical valve seat. The first conical face is adjoined toward the combustion chamber by a second conical face, whose opening angel is greater than that of the valve seat, so that at the transition of the two conical faces, a sealing edge is formed which, in the closing position of the valve member,comes to rest on the valve seat, as a result of a closing force acting on the valve member.

The opening stroke motion of the valve member is exerted by the hydraulic force of the fuel in the pressure chamber, which in the closing position acts, among other effects, on the first conical face and thus causes a resultant force in the axial direction on the valve member. The sealing edge defines the hydraulically effective seat diameter of the valve member and thus, for a given closing force defines the opening pressure of the fuel at which the valve member lifts from the valve seat, counter to the closing force.

The opening pressure of the fuel injection valve depends on the one hand on the closing force acting on the valve member and on the other on the hydraulically effective area of the valve member. In a fuel injection valve, the closing force drops somewhat during operation as a result of relaxation processes in the valve holding body and in the device that generates the closing force. For an optimally functioning fuel injection valve, however, it is important that the opening pressure remain constant during operation. To counteract this relaxation process, the hydraulically effective area of the valve member must decrease. This is achieved by providing that the difference in the cone angles of the valve seat and the first conical face is less than the difference in the cone angles of the second conical face and the valve seat. In operation of the fuel injection valve, the sealing edge presses into the valve seat as a result of plastic deformation, and the hydraulically effective sealing edge shifts from the original sealing edge toward the valve member shaft. This increases the hydraulically effective seat diameter, and the attendant decrease in the area acting in the opening direction compensates at least partly for the dropping closing force, so that the opening pressure remains substantially constant. At a constant closing force, the opening pressure increases accordingly.

In the known valve members, however, it is not possible to determine beforehand how much the hydraulically effective seat diameter of the valve member will change during operation, and thus how markedly the area acting in the opening direction will increase. To achieve at least somewhat replicable results, it is accordingly necessary that both the conical faces and the valve seat be manufactured very exactly and thus cost-intensively.

SUMMARY OF THE INVENTION

In an advantageous feature of the subject of the invention, longitudinal grooves are disposed on the conical face between the valve member shaft and the annular groove. This counteracts a cavitation effect in the annular groove with the attendant problems of wear. If the valve member lifts from the valve seat very rapidly, then it can be happen that at the onset of the opening stroke motion, the fuel cannot flow fast enough into the annular groove through the gap formed between the valve member tip and the valve seat. As a result of the longitudinal grooves, the fuel flow from the pressure chamber into the annular groove is improved, and cavitation cannot occur, or can occur only to a markedly reduced extent.

BRIEF DESCRIPTION OF THE DRAWING

Other features of the invention will become apparent from the description contained below, taken with the drawings, in which.

DESCRIPTION OF THE PREFERRED EMBODIMENTS

Figure 1:
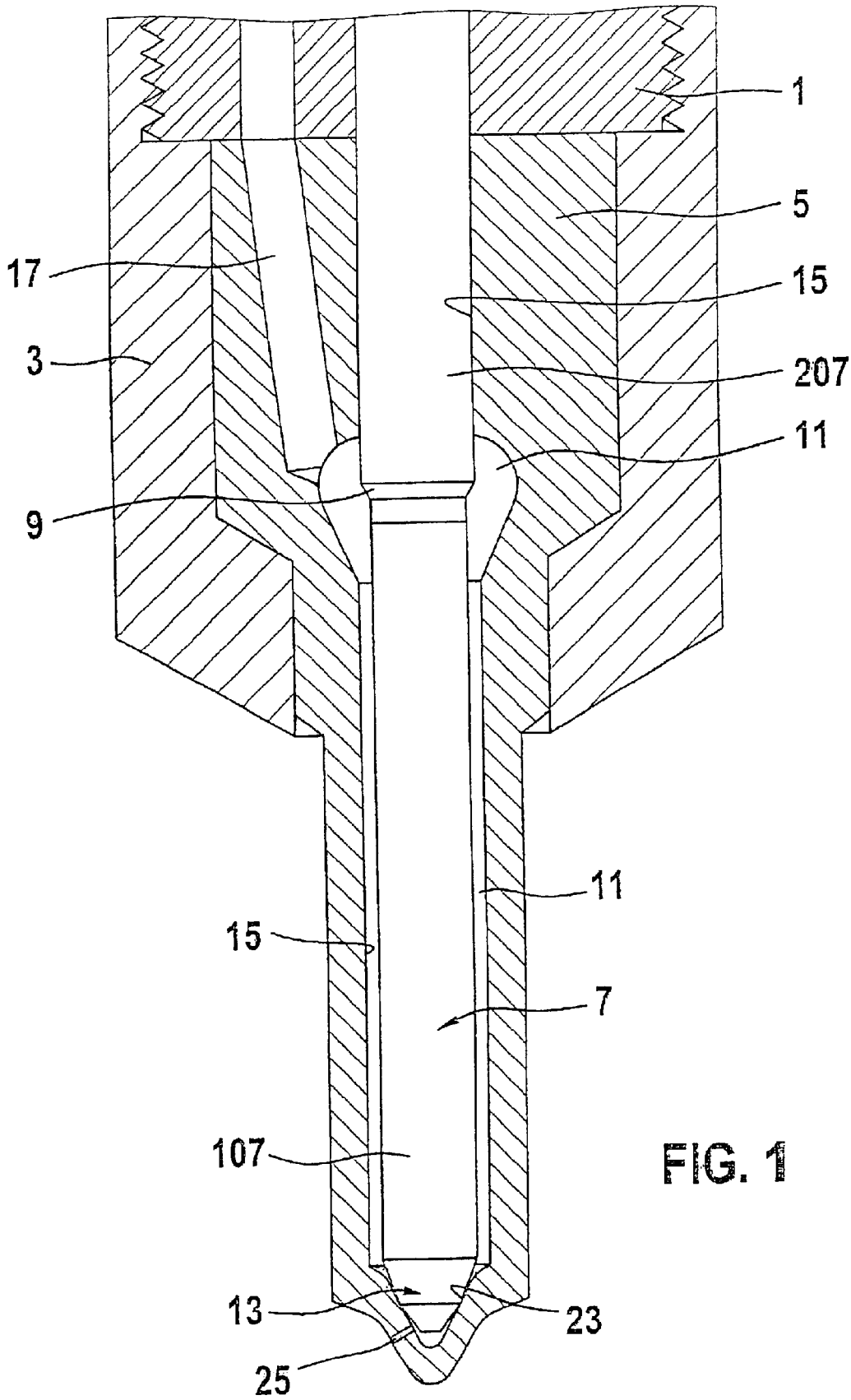
FIG. 1 shows a fuel injection valve partly in longitudinal section.

In FIG. 1, a fuel injection valve for internal combustion engines is shown in partial longitudinal section. A valve body 5 is braced against a valve holding body 1 by means of a fastening element 3; these three elements together form a nozzle holder combination, which in the installed position is disposed in a receiving bore, not shown in the drawing, of an internal combustion engine. A bore 15 is embodied as a blind bore in the valve body 5, and its bottom face is oriented toward the combustion chamber. On the bottom face of the bore 15, a conical valve seat 23 with a cone angle y is formed, along with at least one injection port 25, which connects the bore 15 to the combustion chamber. Disposed in the bore 15 is a pistonlike valve member 7, which has a longitudinal axis 19 and which with a guide portion 207 remote from the combustion chamber is guided in the bore 15 and is thus axially movable. Toward the combustion chamber, the valve member 7 narrows, forming a pressure shoulder 9, and then merges with a valve member shaft 107. On the end of the valve member 7 toward the combustion chamber, there is a valve member tip 13, which narrows toward the combustion chamber. The pressure shoulder 9 is disposed in a pressure chamber 11, embodied in the valve body 5, which toward the combustion chamber changes into an annular conduit surrounding the valve member shaft 107 and extends as far as the bottom face of the bore 15. An inflow conduit 17 is embodied in the valve holding body 1 and in the valve body 5; it discharges into the pressure chamber 11, and by way of the inflow conduit the pressure chamber 11 can be filled with fuel at high pressure.

The valve member 7 is urged toward the combustion chamber by a closing force. The device that generates the closing force is disposed in the valve holding body 1, for instance being in the form of a prestressed spring. It can also be provided that the closing force be generated by a plurality of springs, which depending on the stroke of the valve member 7 generate the closing force individually or in common. Moreover, by the buildup of a pressure in the spring chamber, an additional closing force can be generated. By means of that closing force, the valve member 7 is pressed with the valve member tip 13 against the valve seat 23, thereby closing the pressure chamber 11 off from the injection ports 25. The opening stroke motion of the valve member 7 is effected as a result of the fact that the hydraulic force of the fuel in the pressure chamber 11 is exerted on the pressure shoulder 9 and on at least part of the valve member tip 13. The result is an opening force, acting in the axial direction, on the valve member 7 counter to the closing force. If the opening force is greater than the closing force, then the valve member 7 moves in the bore 15 away from the combustion chamber, and the valve member tip 13 lifts from the valve seat 23. The injection ports 25 now communicate with the pressure chamber 11, and fuel is injected into the combustion chamber. If the ratio of the opening and closing forces is the reverse, the closing motion of the valve member 7 takes place, and by the axial motion of the valve member 7 toward the combustion chamber, the valve member tip 13 comes to rest on the valve seat 23, thus terminating the injection event.

Figure 2:
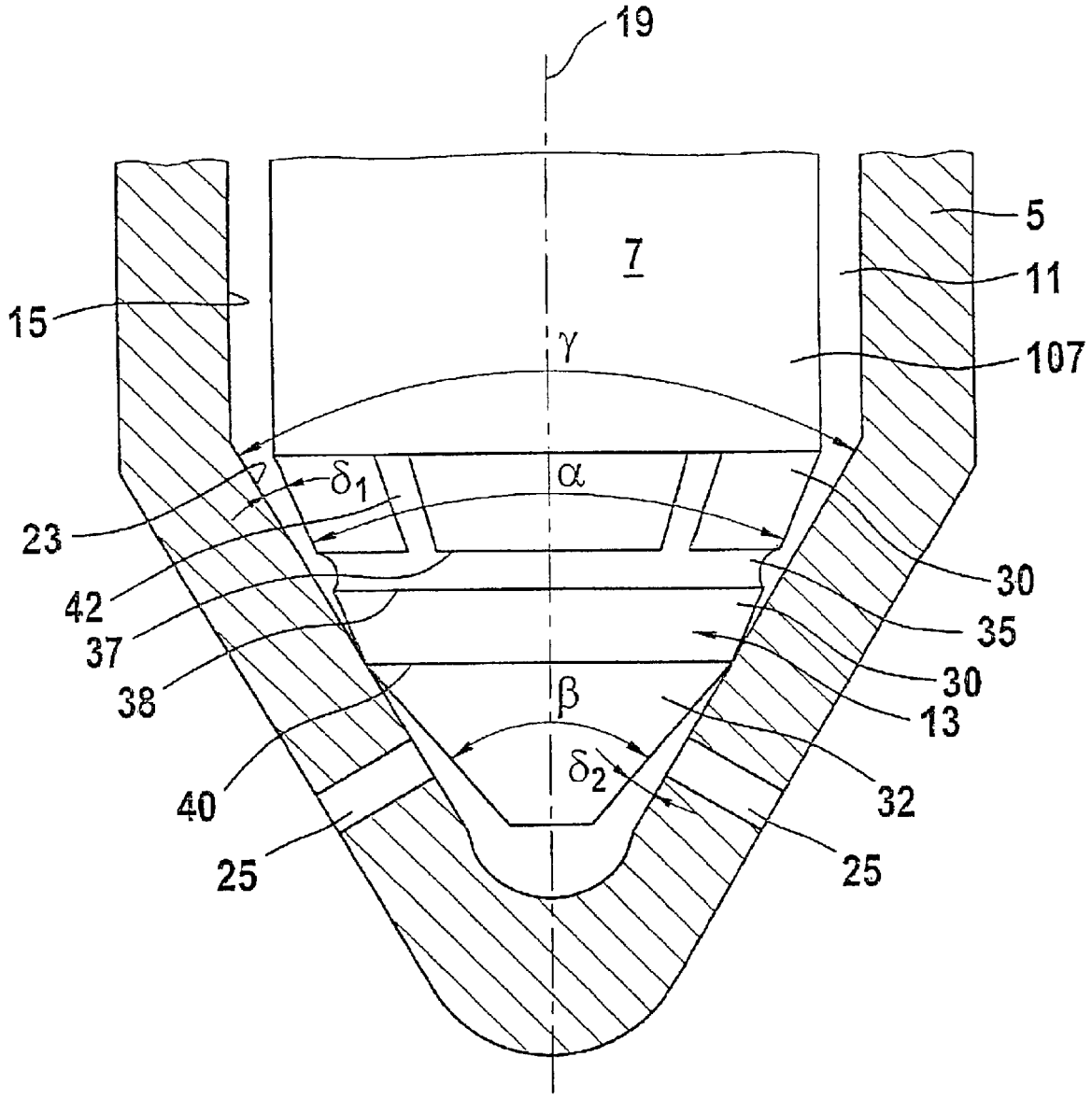
FIG. 2 is an enlarged view of FIG. 1 in the region of the valve seat.

In FIG. 2, the valve member 7 is shown in the region of the valve member tip 13 and in the closing position, while the valve body 5 surrounding the valve member 7 is shown in longitudinal section. A first conical face 30 is embodied on the valve member tip 13; it is adjacent to the valve member shaft 107 and has a cone angle $\alpha$. The cone angle $\alpha$ is less than the cone angle $\gamma$ of the valve seat 23, so that a first differential angle $\delta_1$ is formed between the first conical face 30 and the valve seat 23. The first conical face 30 is adjoined on the valve member tip 13, toward the combustion chamber, by a second conical face 32, whose cone angle $\beta$ is greater than the cone angle $\gamma$ of the valve seat 23. The resultant second differential angle $\delta_2$ formed between the second conical face 32 and the valve seat 23 is greater than the first differential angle $\delta_1$. Because of the transition from the first conical face 30 to the second conical face 32, an encompassing sealing edge 40, located in a radial plane to the longitudinal axis 19 of the valve member 7, is formed on the valve member tip 13. In the closing position of the valve member 7, the valve member tip 13 rests with the sealing edge 40 on the valve seat 23, so that a tight closure of the pressure chamber 11 is attained relative to the injection ports 25, which toward the combustion chamber are disposed in the bottom face of the bore 15 toward the contact point of the sealing edge 40 with the valve seat 23.

An encompassing annular groove 35, which extends in a radial plane to the longitudinal axis 19 of the valve member 7, is disposed on the first conical face 30. The cross section of this annular groove can be in the form of a circular arc or can have some other form suitable for the purpose. For instance, the cross section can be formed by a polygonal line or it can be part of an ellipse. The width of the annular groove is preferably 0.15 to 0.5 mm.

If the valve member 7 opens very quickly, it can happen that cavitation develops in the region of the annular groove 35. It can therefore be provided that the annular groove 35 is connected to the valve member shaft 107 through one or more longitudinal grooves 42. The longitudinal grooves 42 make the inflow of fuel from the pressure chamber 11 into the annular groove 35 easier at the onset of the opening stroke motion, so that cavitation cannot develop, or can develop only to considerably decreased extent. The longitudinal grooves 42 preferably extend parallel to the jacket lines of the first conical face 30, and if more than one longitudinal groove 42 is provided, they are preferably distributed uniformly over the circumference of the valve member 7.

The mode of operation of the valve memser tip 13 designed according to the invention is as follows: In the closing position of the valve member 7, the seating e 40 is pressed against the valve seat 23. In principal this creates a line contact, and high stresses occur both in valve member 7 and in the valve seat 23, which lead to elastic and plastic deformations of thew valve member 7 and valve seat 23, so that over the course of operation, the sealing edge 40 presses into the valve seat 23, and an area contact exists. Since the first differential angle $\delta_1$ is smaller than the second differential angle $\delta_2$, the digging in of the sealing edge 40 shifts the hydraulically effective sealing edge, or in other words the boundry line up to which the pressure of the fuel in the pressure chamber 11 acts in the closing position of the valve member 7, from the sealing edge 40 in the direction of the annular groove 35. When the hyydraulically effective sealing edge reaches the lower edge 38, toward the combustion chamber, of the annular groove, it can no longer migrate any further, and the hydraulically effective sealing edge coincides with the lower edge 38 of the annular groove. By a suitable choice of materials for the valve member 7 and valve seat 23, it can be assured that the valve member tip 13 will not be pressed into the valve seat 23 so far that the upper edge 37 of the annular groove that is, the edge remote from the combustion chamber, will come into contact with the valve seat 23 as well.

The cone angle of the valve seat is 55 to 65°, preferably about 60°. The cone angles of the first conical face 30 and the second conical face 32 are embodied such that the differential angles $\delta_1$, $\delta_2$ are each less than 1.5°. The first differential angle $\delta_1$ is always smaller than the second differential angle $\delta_2$.

The foregoing relates to preferred exemplary embodiments of the invention, it being understood that other variants and embodiments thereof are possible within the spirit and scope of the invention, the latter being defined by the appeneded claims.

I claim:

1. A fuel injection valve for internal combustion engines, comprising a valve body (5) in which a bore (15) is disposed, on the end toward the combustion chamber of which bore a conical valve seat (23) and at least one injection port (25), which connects the bore (15) to the combustion chamber, are disposed, a longitudinally displaceable, pistonlike valve member (7), which is guided in the bore (15) and has a valve member shaft (107), oriented toward the valve seat (23), between which shaft and the wall of the bore (15) a pressure chamber (11) that can be filled with fuel is embodied, and which valve member (7), on its end toward the combustion chamber, has a valve member tip (13) on which a first conical face (30) and a second conical face (32), adjoining the first conical face toward the combustion chamber, cone angle ($\alpha$) of the first conical face (30) is less, and the cone angle ($\beta$) of the second conical face (32) is greater, than the cone angle ($\gamma$) of the valve seat (23), so that an encompassing sealing edge (40) is formed at the transition of the two conical faces (30, 32), which sealing edge, in the closing position of the valve member (7), comes to rest on the valve seat (23) upstream of the injection ports (25) in terms of the fuel flow to the injection ports (25), and an encompassing annular groove (35) is formed on the first conical face (3) of the valve member tip (13).

2. The fuel injection valve of claim 1, wherein the annular groove (35) extends in a radial plane of the longitudinal axis (19) of the valve member (7).

3. The fuel injection valve of claim 2, characterized in that at least one longitudinal groove (42), which connects the valve member shaft (107) to the annular groove (35), is disposed on the conical face embodied between the valve member shaft (107) and the annular groove (35).

4. The fuel injection valve of claim 3, characterized in that the at least one longitudinal groove (42) extends at least nearly parallel to the jacket lines of the first conical face (30).

5. The fuel injection valve of claim 3, characterized in that a plurality of longitudinal grooves (42) are present, which are distributed uniformly over the circumference of the valve member (7).

6. The fuel injection valve of one of the foregoing claims, characterized in that the cone angle (γ) of the valve seat (23) amounts to from 55 to 65°, preferably approximately 60°.

7. The fuel injection valve of one of the foregoing claims, characterized in that the difference in the cone angles of the first conical face (30) and the valve seat (23) amounts to less than 1.5°, preferably 0.5 to 1.0°.

8. The fuel injection valve of claim 7, characterized in that the difference in the cone angles of the second conical face (32) and the valve seat (23) amounts to less than 1°, preferably 0.5 to 0.70.

9. The fuel injection valve of claim 7 wherein the difference in the cone angles of the first conical face (30) and the valve seat (23) amounts to less than 1.5°, preferably 0.5 to 1.0°.

10. The fuel injection valve of claim 9 wherein the difference in the cone angles of the second conical face (32) and the valve seat (23) amounts to less than 1°, preferably 0.5 to 0.7°.

11. The fuel injection valve of claim 3 wherein the difference in the cone angles of the first conical face (30) and the valve seat (23) amounts to less than 1.5°, preferably 0.5 to 1.0°.

12. The fuel injection valve of claim 11 wherein the difference in the cone angles of the second conical face (32) and the valve seat (23) amounts to less than 1.0 preferably 0.5 to 0.7°.

13. The fuel injection valve of claim 2 wherein the cone angle (γ) of the valve seat (23) amounts to from 55 to 65°, preferably approximately 60°.

14. The fuel injection valve of claim 1, wherein the cone angle (γ) of the valve seat (23) amounts to from 55 to 65°, preferably approximately 60°.

15. The fuel injection valve of claim 14 wherein the difference in the cone angles of the first conical face (30) and the valve seat (23) amounts to less than 1.5°, preferably 0.5 to 1.0°.

16. The fuel injection valve of claim 15 wherein the difference in the cone angles of the second conical face (32) and the valve seat (23) amounts to less than 1°, preferably 0.5 to 0.7°.

17. The fuel injection valve of claim 1 wherein the difference in the cone angles of the first conical face (30) and the valve seat (23) amounts to less than 1.5°, preferably 0.5 to 1.0°.

18. The fuel injection valve of claim 17 wherein the difference in the cone angles of the second conical face (32) and the valve seat (23) amounts to less than 1°, preferably 0.5 to 0.7°.

* * * * *